US008689470B2

(12) United States Patent
Thomas

(10) Patent No.: US 8,689,470 B2
(45) Date of Patent: Apr. 8, 2014

(54) EXCAVATOR

(76) Inventor: Gareth John Thomas, Sam (GB)

( * ) Notice: Subject to any disclaimer, the term of this patent is extended or adjusted under 35 U.S.C. 154(b) by 325 days.

(21) Appl. No.: 12/280,947

(22) PCT Filed: Mar. 1, 2007

(86) PCT No.: PCT/GB2007/000709
§ 371 (c)(1),
(2), (4) Date: Jul. 27, 2009

(87) PCT Pub. No.: WO2007/099319
PCT Pub. Date: Sep. 7, 2007

(65) Prior Publication Data

US 2010/0170118 A1 Jul. 8, 2010

(30) Foreign Application Priority Data

Mar. 1, 2006 (GB) ..... 0604176.8

(51) Int. Cl.
*B60P 1/36* (2006.01)

(52) U.S. Cl.
USPC ..... 37/305; 37/359; 414/565; 198/517

(58) Field of Classification Search
USPC ..... 37/304, 305, 352, 359, 364, 379, 397, 37/403, 422, 419; 198/312, 313, 509; 414/565, 567
See application file for complete search history.

(56) References Cited

U.S. PATENT DOCUMENTS 2,983,496 A 5/1961 Grant
3,390,473 A * 7/1968 Wilms et al. ..... 37/190
3,391,776 A 7/1968 Hancock et al.
3,547,287 A 12/1970 Cunningham et al.
3,595,411 A 7/1971 Ables
3,710,472 A 1/1973 Gremillion et al.
3,878,952 A 4/1975 Hueftle
3,893,480 A * 7/1975 Dunbar ..... 137/615

(Continued)

FOREIGN PATENT DOCUMENTS

CA 1 264 701 1/1990
DE 261226 7/1910

(Continued)

OTHER PUBLICATIONS

Apparatus made available to the public on May 27, 1978.

(Continued)

*Primary Examiner* — Jamie L McGowan
(74) *Attorney, Agent, or Firm* — Merchant & Gould P.C.

(57) ABSTRACT

An excavator (1) includes an excavator main body (7), an apron (2) for the receipt of excavated material and a conveyor (3), the apron being located at or in proximity to the front of the main body, the conveyor extending from the apron to the rear of the main body. In use, the conveyor moves excavated material from the front to the rear of the main body, the excavator further includes an arm (11) having an attachment (5) for excavating material and moving the excavating material towards the apron (2). The excavator has a support associated with the front of the main body, the support being movable from a first position in which the support is in resilient contact with the ground to a second position in which there is substantially no contact between the support and the ground. The support includes one or both of the apron and conveyor.

22 Claims, 3 Drawing Sheets

(56) References Cited

U.S. PATENT DOCUMENTS

| | | | | | |
|---|---|---|---|---|---|
| 3,912,024 | A * | 10/1975 | Richmond et al. | 173/152 |
| 3,997,068 | A | 12/1976 | Lock | |
| 4,011,936 | A | 3/1977 | Hall | |
| 4,011,937 | A | 3/1977 | Brandtjen | |
| 4,087,010 | A | 5/1978 | Stormon | |
| 4,099,579 | A | 7/1978 | Stormon | |
| 4,100,688 | A | 7/1978 | Grist | |
| 4,184,581 | A | 1/1980 | Crawshay et al. | |
| 4,196,800 | A | 4/1980 | Hall | |
| 4,295,560 | A * | 10/1981 | Cross | 198/517 |
| 4,297,799 | A | 11/1981 | Sonerud | |
| 4,379,672 | A | 4/1983 | Hunter | |
| 4,417,628 | A | 11/1983 | Gessner | |
| D274,525 | S | 7/1984 | Jordan et al. | |
| 4,462,747 | A * | 7/1984 | Caplis et al. | 414/567 |
| 4,490,070 | A | 12/1984 | Upchurch et al. | |
| 4,571,145 | A | 2/1986 | Hunter | |
| 4,573,743 | A | 3/1986 | Grathoff | |
| 4,793,732 | A | 12/1988 | Jordon | |
| 4,803,789 | A | 2/1989 | Hackmack | |
| 4,837,950 | A * | 6/1989 | Vesper | 37/305 |
| 4,852,277 | A | 8/1989 | Ward | |
| 4,974,349 | A | 12/1990 | Timmons | |
| 4,996,830 | A | 3/1991 | Davison | |
| 5,228,220 | A | 7/1993 | Bryan, Jr. | |
| 5,234,094 | A * | 8/1993 | Weyermann et al. | 198/303 |
| 5,237,762 | A | 8/1993 | Sandberg | |
| 5,256,021 | A * | 10/1993 | Wolf et al. | 414/393 |
| 5,423,137 | A | 6/1995 | Cochran | |
| 5,575,538 | A | 11/1996 | Gilbert et al. | |
| 5,592,761 | A | 1/1997 | Ward | |
| 5,647,691 | A * | 7/1997 | Wirth | 405/74 |
| 5,868,211 | A | 2/1999 | Bohn | |
| 6,085,446 | A * | 7/2000 | Posch | 37/343 |
| 6,193,444 | B1 | 2/2001 | Jonninen | |
| 6,312,194 | B1 | 11/2001 | Simons | |
| 6,405,460 | B1 | 6/2002 | Whitmire et al. | |
| 6,530,742 | B2 * | 3/2003 | Trinler et al. | 414/718 |
| 6,626,499 | B1 | 9/2003 | Schenk et al. | |
| 7,311,489 | B2 * | 12/2007 | Ekman | 414/723 |
| 2001/0002974 | A1 * | 6/2001 | Dimillo | 414/565 |
| 2002/0124441 | A1 | 9/2002 | Mallaghan | |
| 2004/0148823 | A1 | 8/2004 | Schenk | |
| 2009/0025261 | A1 * | 1/2009 | Ganz | 37/305 |

FOREIGN PATENT DOCUMENTS

| | | | | |
|---|---|---|---|---|
| DE | 3603675 | | 7/1986 | |
| DE | 38 09 670 | A1 | 10/1989 | |
| DE | 42 08 245 | A1 | 9/1993 | |
| DE | 299 24 641 | | 9/2004 | |
| EP | 113266 | A1 * | 7/1984 | E02F 3/32 |
| EP | 0334 143 | | 3/1989 | |
| EP | 0971 076 | | 1/2000 | |
| EP | 1 199 407 | | 2/2002 | |
| EP | 1 273 411 | | 1/2003 | |
| EP | 1 627 961 | | 2/2006 | |
| EP | 1 627 961 | A1 | 2/2006 | |
| FR | 2 839 742 | | 11/2003 | |
| GB | 191016075 | | 4/1911 | |
| GB | 1 291 318 | | 10/1972 | |
| GB | 1 427 076 | | 3/1976 | |
| GB | 1482357 | | 8/1977 | |
| GB | 1 553 431 | | 9/1979 | |
| GB | 1 565 803 | | 4/1980 | |
| GB | 1 567 412 | | 5/1980 | |
| GB | 1 575 371 | | 9/1980 | |
| GB | 1575371 | | 9/1980 | |
| JP | 55-16147 | | 2/1980 | |
| JP | 55-36565 | | 3/1980 | |
| JP | 58-131239 | | 8/1983 | |
| JP | 1-207507 | | 8/1989 | |
| JP | 3-206215 | | 9/1991 | |
| JP | 9-32034 | | 2/1997 | |
| JP | 9-88354 | | 3/1997 | |
| JP | 11-247223 | | 9/1999 | |
| JP | 11-310915 | | 11/1999 | |
| JP | 2000-273896 | | 10/2000 | |
| JP | 2000-282788 | | 10/2000 | |
| JP | 2000-336689 | | 12/2000 | |
| JP | 2003-119822 | | 4/2003 | |
| JP | 2003-213720 | | 7/2003 | |
| JP | 2004-255526 | | 9/2004 | |
| JP | 2005-201005 | | 7/2005 | |
| WO | WO 93/06306 | | 4/1993 | |
| WO | WO 95/13432 | | 5/1995 | |
| WO | WO 98/11304 | | 3/1998 | |
| WO | WO 98/44206 | | 4/1998 | |
| WO | WO 98/44206 | | 10/1998 | |
| WO | WO 02/095144 | | 11/2002 | |

OTHER PUBLICATIONS

Apparatus made available to the public on May 16, 1979.
Apparatus made available to the public on Sep. 29, 1979.

* cited by examiner

EXCAVATOR

This application is a National Stage Application of PCT/GB2007/000709, filed Mar. 1, 2007, which claims benefit of Serial No. 0604176.8, filed Mar. 1, 2006 in Great Britain and which application(s) are incorporated herein by reference. A claim of priority to all, to the extent appropriate is made.

BACKGROUND OF THE INVENTION

The present invention relates to an excavating vehicle, particularly but not exclusively the type of vehicle that is used to remove rock, coal and other hard substances from a substrate.

Many excavators are known for the excavation of rock, coal and other relatively hard materials. Some such excavators are provided with conveyors that extend from the front to the rear of a prime mover. Such an arrangement is convenient when working in an enclosed space where it would not be possible to move an excavator arm from the front to the rear of a prime mover. Working in enclosed spaces also presents further problems, such as operating carbon-monoxide emitting engines in enclosed spaces.

SUMMARY OF THE INVENTION

The excavators of the present invention address one or more of these problems or problems that have not previously been identified in relation to this type of excavator.

In accordance with a first aspect of the present invention there is provided an excavator comprising an excavator main body, an apron for the receipt of excavated material and a conveyor, the apron being located at or in proximity to the front of the main body, the conveyor extending from the apron to the rear of the main body, the conveyor, in use, moving excavated material from the front to the rear of the main body, the excavator further comprising an arm comprising an attachment for excavating material and moving said excavated material towards the apron the excavator comprising a support associated with the front of the main body, the support being movable from a first position in which the support is in resilient contact with the ground to a second position in which there is substantially no contact between the support and the ground.

The support is typically located at, or in proximity to, the front of the main body.

This is an effective arrangement for inhibiting unwanted movement of the excavator when the excavating attachment is used to excavate material. It has been found that, when there is no resilient contact between the ground and the support, the hammering or cutting action of the excavating attachment (especially in hard rock) causes a large recoil force to be exerted on the vehicle via the arm. Such a force caused the rear end of the main body to be raised from the ground, which may unseat the operator. The resilient contact between the ground and support may, for example, create an upwards force of from 1 to 2 tonnes. This range is particularly useful for an excavator having a weight of from 3 to 5 tonnes. The resilient contact between the ground and the support may create an upwards force of from 25% to 60% of the weight of the excavator, and preferably from 30% to 50% of the weight of the excavator.

The main body may be a prime mover for moving the excavator. The main body may include an engine or the like for moving the excavator. The main body further may include a driver's cab, and may typically include a wheeled or caterpillar-tracked arrangement for moving the excavator. The main body does not include any of the apron, the conveyor or arm.

The support may comprise one or both of the apron and conveyor. In this case, the apron and/or conveyor would be movable from a first position in which the support is in resilient contact with the ground to a second position in which there is substantially no contact between the support and the ground. It is preferred that the support comprises both the apron and the conveyor.

In this case, the apron and/or conveyor may be in direct contact with the ground when the support is in the first position. Alternatively, the support may be provided with an intermediate member for contacting the ground, such as a plate. The use of such an intermediate member helps inhibit damage to the apron and/or conveyor.

The use of one or both of the apron and conveyor as part of the support removes the need for separate jacks.

It is preferred that the apron and conveyor are attached to one another. This provides a convenient arrangement for providing resilient contact between the ground and the vehicle and ensuring that the conveyor and apron are in the correct position relative to one another for delivering excavated material to the conveyor.

It is preferred that the conveyor and apron each has a material-receiving surface for receiving excavated material, and that the material-receiving surface of the conveyor is, in use, lower than the material-receiving surface of the apron. This provides a good arrangement for delivering material to the conveyor.

The support may be provided with an intermediate member for contacting the ground in the first position, such as a contact plate. This helps limit damage to the rest of the support.

The conveyor is preferably a belt conveyor, but may be another form of conveyor, such as a screw conveyor.

It is preferred that the excavator is further provided with a piston for moving the support between the first and second positions. It is preferred that, in the first position, the piston resiliently urges the support into the ground.

The piston may be hydraulic, and may be mounted on the prime mover. It is preferred that the piston is, in use, substantially normal to the ground.

The conveyor may be provided with one or more seals that resiliently engage with a surface of the main body. The one or more seals assist in inhibiting ingress of excavated material into the internal workings of the main body.

The main body may be provided with a driver's cab. The cab may be enclosed so as to inhibit ingress of excavated material into the cab and to inhibit unwanted egress of the driver.

It is preferred that the main body has a length of from 0.9 m to 6 m and a width of from 0.6 m to 6 m.

It is preferred that the arm is rotatably attached to the prime mover, attachment of the arm to the main body providing a first pivotal axis, the arm being rotatable in relation to the main body through an angle of at least 150 degrees about said first pivotal axis.

The arm may be attached to the main body at, or in proximity to, the front of the main body. This is a convenient arrangement for excavating material in front of the main body.

It is further preferred that the arm is rotatable in relation to the main body through an angle of at least 300 degrees (and more preferably through an angle of at least 350 degrees) about the first pivotal axis. Such a rotational motion allows the arm to act as a crane. It also assists in storage of the arm.

If the arm is rotatable through 180 degrees or less, it is preferred that the excavator is provided with one or more rams for rotating the arm about the first pivotal axis.

If the arm is rotatable through more than 180 degrees, it is preferred that the excavator may be provided with a slew ring and motor for rotating the arm about the first pivotal axis.

It is preferred that the arm is provided with a hydraulic conduit for transmitting hydraulic pressure extending from the main body to the attachment. It is preferred that the arm is provided with a cover above at least a part of the hydraulic conduit. This protects the hydraulic conduit from being urged into a roof of a chamber when working in an enclosed environment.

It is preferred that the arm is articulated, with an upper arm portion associated with the main body connected to a lower arm portion by a joint, the cover extending the length of the upper arm portion. The lower arm portion may be attached to the excavating attachment. The upper arm portion may be rotatably attached to the main body to form the first pivotal axis.

It is preferred that the excavating attachment comprises a cutter portion for excavating rock or the like and a scoop portion for moving and collecting excavated rock. The scoop portion may be in the form of a bucket portion. The bucket portion is able to pick-up excavated rock. Alternatively, the scoop portion may be unable to pick-up excavated rock. The scoop portion may comprise a rear wall and two sides walls, the side walls projecting from the rear wall. The side walls assist in keeping the excavated and scooped rock in one place so that it easier to move to the apron and conveyor.

The excavating attachment may be provided with one or more water cannon. The one or more water cannon may be operable to project a spray of water at the cutter portion of the excavating attachment. The spray comprises high velocity water droplets which suppress dust. The spray also comprises high velocity air for purging the region around the cutter portion of dangerous gases, such as methane.

It is preferred that the excavator is provided with a power pack and further preferred that the power pack is mountable on the main body in a first operational power pack position, and is readily dismountable from the main body to be moved to a second operational power pack position remote from the main body, the excavator being adapted to enable power to be transmitted to the main body and the excavating attachment in the first and second operational power pack positions.

This enables the main body and attachment to be operated remote from the power pack. This is of particular assistance if, for example, the power pack runs-off fossil fuels and emits potentially dangerous fumes, such as carbon monoxide, or if the power pack is electrically powered and the main body and excavator are operating in areas subject to the build-up of explosive gases such as methane.

It is preferred that the excavator is provided with one or more power transmission conduits for connecting the power pack in the second operational power pack position to the main body. Such power transmission conduits may be electrical cables or may be conduits for the transmission of hydraulic fluid.

The main body may be provided with a power transmission conduit receiving arrangement for connection to the one or more power transmission conduits. For example, the main body may be provided with the female or male parts of an electrical connection, the corresponding male or female part being provided on the one or more power transmission conduits. Alternatively, the main body may be provided with the male or female parts of a hydraulic fluid connection, the corresponding male or female part being provided on the one or more power transmission conduits.

In accordance with a second aspect of the present invention there is provided an excavator comprising an excavator main body, an excavator attachment for the excavation of material and a power pack for supplying power to the main body and the excavator attachment, wherein the power pack is mountable on the main body in a first operational power pack position, and is readily dismountable from the main body to be moved to a second operational power pack position remote from the main body, the excavator being adapted to enable power to be transmitted to the main body and the excavating attachment in the first and second operational power pack positions.

This enables the main body and attachment to be operated remote from the power pack. This is of particular assistance if, for example, the power pack runs-off fossil fuels and emits potentially dangerous fumes, such as carbon monoxide, or if the power pack is electrically powered and the main body and excavating attachment are operating in areas subject to the build-up of explosive gases such as methane.

The main body may include an engine or the like for moving the excavator. The main body further may include a driver's cab, and may typically include a wheeled or caterpillar-tracked arrangement for moving the excavator. The main body does not include any of the apron, the conveyor or arm (if present).

It is preferred that the excavator is provided with one or more power transmission conduits for connecting the power pack in the second operational power pack position to the main body. Such power transmission conduits may be electrical cables or may be conduits for the transmission of hydraulic fluid.

The main body may be provided with a power transmission conduit receiving arrangement for connection to the one or more power transmission conduits. For example, the main body may be provided with the female or male parts of an electrical connection, the corresponding male or female part being provided on the one or more power transmission conduits. Alternatively, the main body may be provided with the male or female parts of a hydraulic fluid connection, the corresponding male or female part being provided on the one or more power transmission conduits.

In accordance with a third aspect of the invention, there is provided an excavator comprising an excavator main body, a conveyor for the movement of excavated material, the conveyor extending from the front to the rear of the main body, the conveyor, in use, moving excavated material from the front to the rear of the main body, an arm comprising an excavator attachment for excavating material and moving it towards or onto the conveyor, wherein the arm is rotatably attached to the prime mover, attachment of the arm to the main body providing a first pivotal axis, the arm being rotatable in relation to the main body through an angle of at least 300 degrees about said first pivotal axis.

The main body may be a prime mover for moving the excavator. The main body may include an engine or the like for moving the excavator. The main body further may include a driver's cab, and may typically include a wheeled or caterpillar-tracked arrangement for moving the excavator. The main body does not include any of the apron, the conveyor or arm (if present).

The arm may be attached to the main body at, or in proximity to, the front of the main body. This is a convenient arrangement for excavating material in front of the prime mover.

It is further preferred that the arm is rotatable in relation to the main body through an angle of at least 350 degrees about the first pivotal axis. Such a rotational motion allows the arm to reach behind the main body to act as a crane. It also assists in storage of the arm.

It is preferred that the excavator is provided with a slew ring and motor for rotating the arm about the first pivotal axis.

The excavators of the second and third aspects of the present invention may comprise those features described above with reference to the first aspect of the present invention. For example, the conveyor may be a belt conveyor.

BRIEF DESCRIPTION OF THE DRAWINGS

The excavator of the present invention will now be described by way of example only with reference to FIGS. 1, 2 and 3 of which.

DETAILED DESCRIPTION OF THE PREFERRED EMBODIMENT

Figure 1:
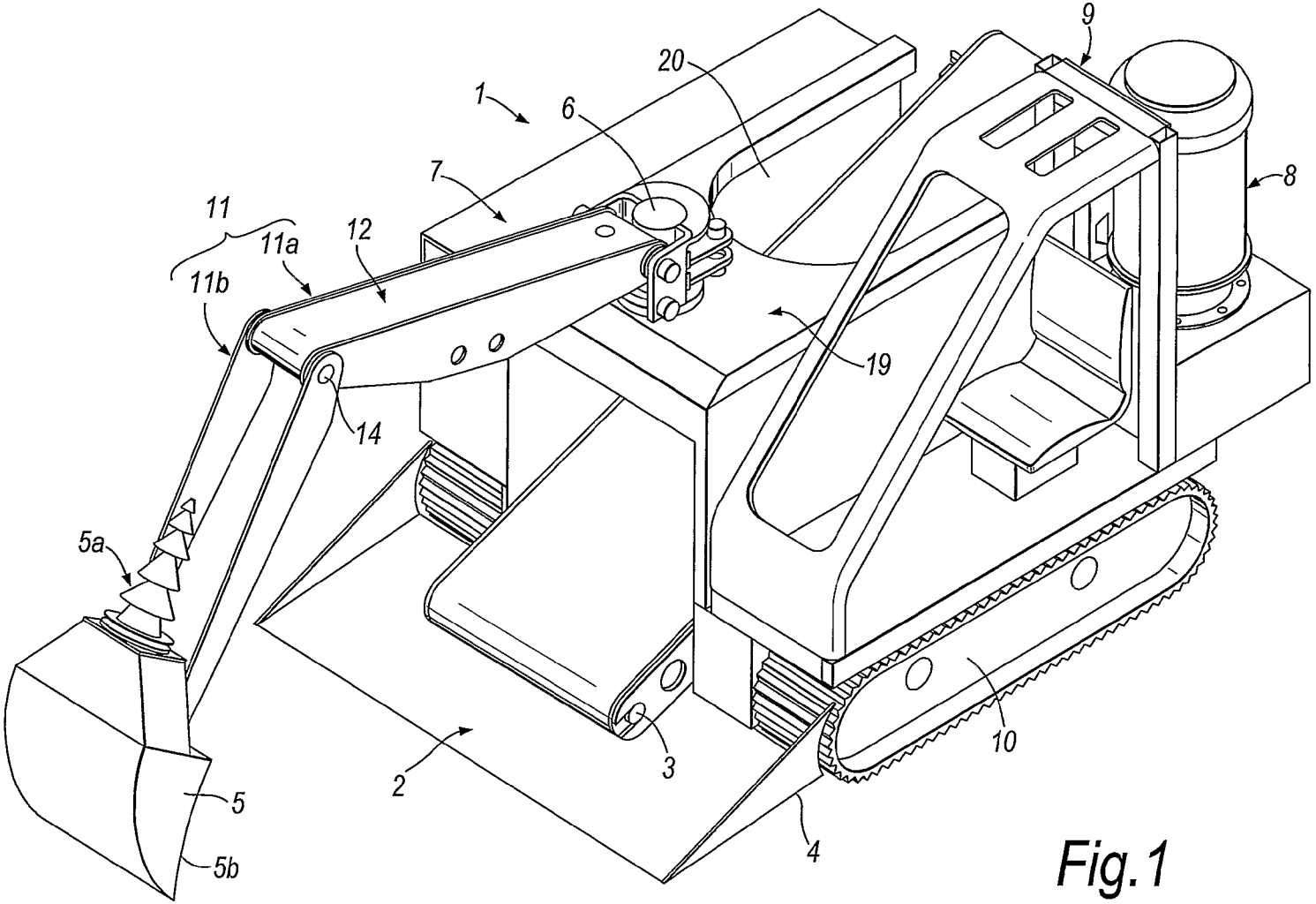
FIG. 1 is a perspective view of an embodiment of an excavator in accordance with the present invention.

FIG. 1 shows an excavator in accordance with the first, second and third aspects of the present invention. The excavator is shown generally by reference numeral 1 and comprises an excavator main body 7, an apron 2 for the receipt of excavated material and a conveyor 3. The apron 2 is located at or in proximity to the front of the main body 7, the conveyor 3 extending from the apron 2 to the rear of the main body, the conveyor, in use, moving excavated material from the front to the rear of the main body. The excavator further comprises an arm 11 comprising an attachment 5 for excavating material and moving said excavating material towards the apron 2. The excavator comprises a support, which in this case comprises the conveyor 3 and apron 2. A contact plate 4 for contacting the ground is provided on the underside of the conveyor and apron. The conveyor 3 and apron 2 are movable from a first position in which the support is in resilient contact with the ground to a second position in which there is substantially no contact between the support and the ground. In the first position, the contact plate 4 (as opposed to any surface of the apron or conveyor themselves) is in contact with the ground. This helps limit damage to the conveyor and/or apron that may be caused by contacting the apron and/or conveyor with the ground.

The main body 7 of the excavator is provided with caterpillar tracks 10 to move the excavator.

Figure 2:
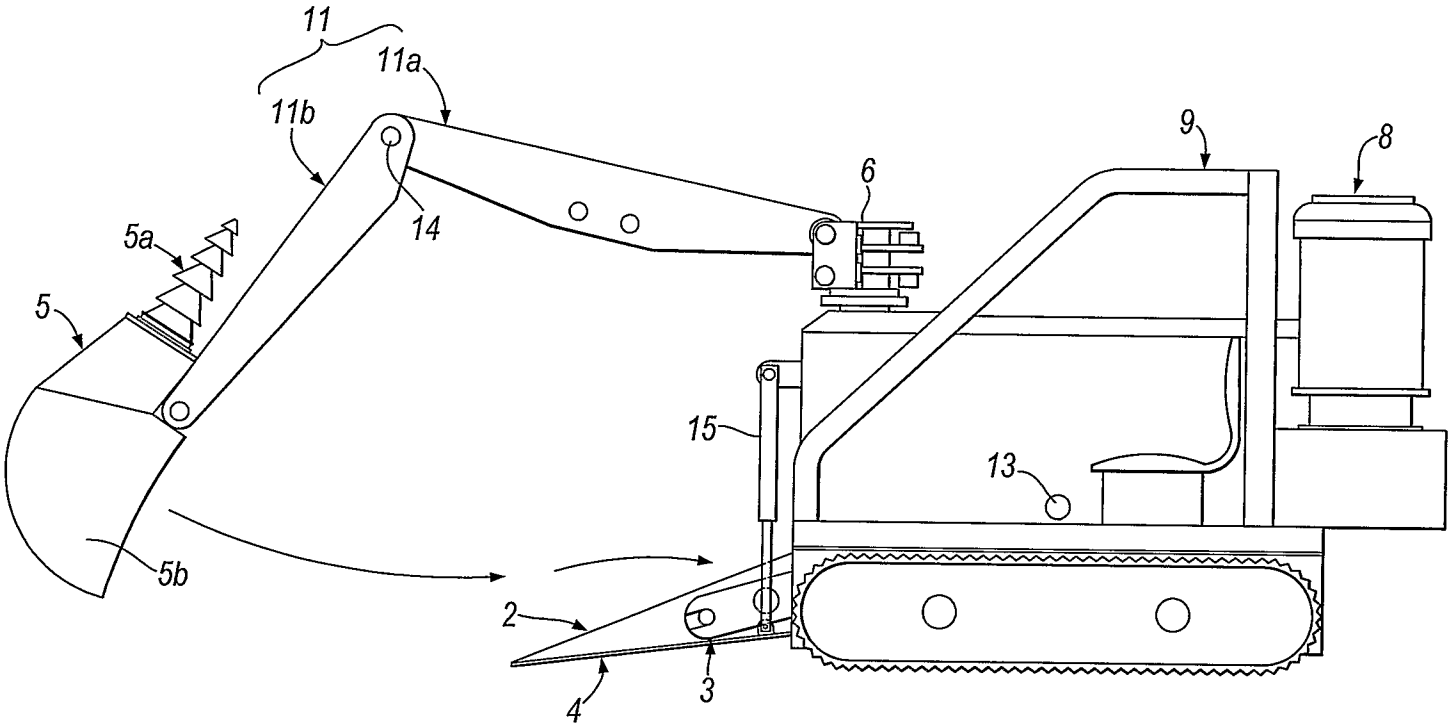
FIG. 2 is a side-on schematic view of the excavator of FIG. 1.

When the excavator 1 is to be used to excavate material, the excavator is moved into position. When the excavator 1 is moving, the conveyor and apron are clear of the ground (in the second position) so that neither catches on the ground during movement of the excavator. Referring to FIG. 2, when the excavator 1 is in position for excavation, piston 15 is activated, urging the contact plate attached to the apron 3 and conveyor 2 into resilient contact with the ground. The piston 15 urges the contact plate 4 into the ground with a force of about 2 to 3 tonnes. This force is generally insufficient to raise the main body of the excavator 1 from the floor. Excavating attachment 5 is then used to excavate material from a substrate, such as a rock face or coal seam. Such excavation requires cutting tool 5*a* to be urged with some considerable force into the substrate. This causes a large recoil force to be transmitted through arm 11 to the main body 7. Because the arm 11 is connected to the main body 7 at, or in proximity to, the front of the main body 7, the recoil causes a downward force on the main body 7, applied to the front of the main body 7. The force exerted by the contact plate 4 associated with the apron and conveyor being urged into the ground by piston 15 counteracts this recoil force and the main body 7 has far less tendency to rock or tip than if the contact plate is not urged into the ground. If the contact plate is not being urged into the ground, the recoil force causes the rear end of the main body 7 to tip violently, in certain cases throwing the driver from the cab 9.

Once material has been removed from the substrate, the articulated arm 11 moves the bucket portion 5*b* of the attachment 5 so as to collect and move excavated material towards apron 2. The apron 2 is arranged to have a leading edge in contact with the ground, enabling material to be easily moved up the apron 2 to the conveyor 3.

The material-receiving surface of the conveyor 3 is lower than the material receiving surface of the apron 2 and so material may be readily moved from apron 2 to conveyor 3. The conveyor 3 extends from the front to the rear of the main body 7 and moves material to the rear of the main body. A seal (not shown) is provided between the edges of the conveyor 3 and the main body 7 to inhibit ingress of excavated material into the workings of the main body 7.

The arm 11 is articulated and comprises an upper portion 11*a* attached to lower portion 11*b* by a hinged, elbow-type joint 14. The upper portion 11*a* is attached at one end to the main body, thus providing a pivotal attachment 6 for rotation of the arm 11 in relation to the main body 7. The arm 11 is attached to the main body by a slew ring (not shown) and so may be moved by a motor continuously about the pivotal attachment. The upper portion 11*a* is provided with a cover 12 to protect the hydraulic conduits (not shown) extending from the main body 7 to attachment 5. This is useful when operating the excavator in an enclosed space with a low roof.

The main body is provided with an enclosed driver's cab 9. The cab is provided with windows (not shown) that inhibit ingress of excavated material into the cab. This is particular useful when the excavating tool is used to excavate material at a height of 2.5 m or more above the ground level because in such cases excavated material may run along the arm towards the cab.

The conveyor is mounted on the main body 7 to pivot about axis 13. This pivotal axis 13 allows the apron and conveyor to be urged into the first position in which the contact plate is in contact with the ground, and also allows the conveyor and apron to be raised to allow movement of the excavator. A cut-out 20 is provided in the roof 19 of the main body 7. This cut-out 20 allows the arm 11 to be rotated to the rear of the main body 7 and articulated so that lower arm portion 11*b* may be stored in the space above conveyor 3. The conveyor is moved so that it is essentially level with the ground (i.e. the front portion of the conveyor is raised) to make room for the lower arm portion 11*b*.

Figure 3:
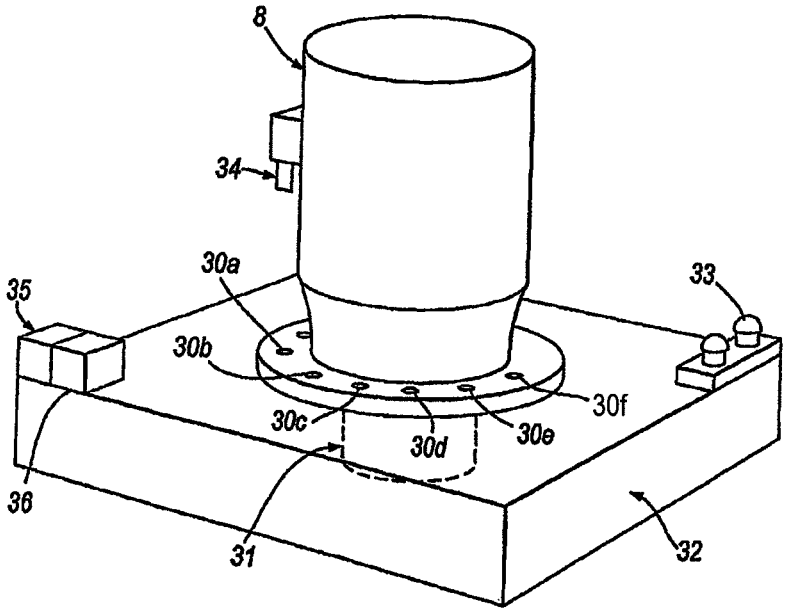
FIG. 3 is a perspective view of the rear portion of the excavator showing in more detail the removable power pack.

Referring now to FIGS. 1, 2 and 3, the excavator is provided with a power pack 8. The power pack is shown mounted on the main body 7 in a first operational power pack position. The power pack is readily removable from the first operational power pack position by virtue of it being mounted on the main body 7 with readily removable bolts (exemplified by reference numerals 30*a-f*). The power pack 8 comprises, in this case, an electric motor. The power pack 8 may be moved away from the main body 7, being connected to the main body by conduits carrying hydraulic fluid and pressure from the remotely sited power pack 8 to the main body 7. The power pack 8 is provided with an electrical input socket 34 for providing electricity to the electrical motor. The electric motor provides power to a hydraulic pump 31 that is provided as part of the removable power pack. The hydraulic pump 31 pumps hydraulic fluid from the hydraulic fluid tank 32 (which is recessed into the main body 7) to the hydraulically operated components of the main body 7 and the attachment 5. The main body 7 and hydraulic pump 31 are provided with quick release couplings (shown as 33 for those provided in the main body) to enable conduits to be readily connected to, and disconnected from, the power pack 8 and main body 7. The quick release couplings are provided for both the "pressure" and "return" hydraulic circuits. Pressure relief valves are also provided in case the hydraulic pressure exceeds a predetermined value. Isolators are also provided for both the electric and hydraulic circuits.

The engine or motor for powering the excavator may, of course, be petrol, diesel or air powered (as opposed to electrically powered). A control panel 35 and emergency stop 36 are provided on the main body 7 to control the operation of the power pack 8, irrespective of whether the power pack 8 is mounted on, or remote to, the main body.

Wherein the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional.

The invention claimed is:

1. An excavator vehicle comprising:

an excavator main body having a front and a rear, an apron for the receipt of excavated material and a conveyor, the apron being located at or in proximity to the front of the main body, the conveyor extending from the apron to the rear of the main body and being operable to move excavated material from the front to the rear of the main body, an arm comprising an excavating attachment for excavating material and moving said excavating material towards the apron, the excavating attachment comprising a cutter portion for excavating rock and other material and a bucket portion to move and collect excavated rock and other material;

a support associated with the front of the main body, the support being movable from a first position in which the support is in resilient contact with the ground to a second position in which there is substantially no contact between the support and the ground, wherein the support comprises one or both of the apron and conveyor, the apron and/or conveyor being movable from a first position in which the support is in resilient contact with the ground to a second position in which there is substantially no contact between the support and the ground, wherein when the support is in resilient contact with the ground, the resilient contact between the ground and the support creates an upwards force of from 25% to 60% of the weight of the excavator vehicle;

a power pack operable to enable power to be transmitted to the main body and the excavating attachment when the power pack is located remotely from the main body.

2. An excavator vehicle according to claim 1 wherein unwanted movement of the excavator vehicle is inhibited when the excavating attachment is used to excavate material.

3. An excavator vehicle according to claim 1 wherein when the support is in resilient contact with the ground, the resilient contact between the between the ground and the support creates an upwards force of from 30% to 50% of the weight of the excavator.

4. An excavator vehicle according to claim 1, wherein the apron and/or conveyor is in direct contact with the ground when the support is in the first position.

5. An excavator vehicle according to claim 1, wherein the support is provided with an intermediate member for contacting the ground, wherein the intermediate member contacts the ground when the support is in the first position.

6. An excavator vehicle according to claim 5 wherein the intermediate member comprises a contact plate.

7. An excavator vehicle according to claim 1, wherein the apron and conveyor are attached to one another, and that the conveyor and apron each has a material-receiving surface for receiving excavated material, the material-receiving surface of the conveyor being lower than the material-receiving surface of the apron.

8. An excavator vehicle according to claim 1, wherein the conveyor is provided with one or more seals that resiliently engage with a surface of the main body.

9. An excavator vehicle according to claim 1, wherein the main body is provided with a driver's cab which is enclosed so as to inhibit ingress of excavated material into the cab and to inhibit unwanted egress of the driver.

10. An excavator vehicle according to claim 1, wherein the arm is rotatably attached to the main body, attachment of the arm to the main body providing a first pivotal axis, the arm being rotatable in relation to the main body through an angle of at least 150 degrees about said first pivotal axis.

11. An excavator vehicle according to claim 10 wherein the arm is rotatable in relation to the main body through an angle of at least 300 degrees.

12. An excavator vehicle according to claim 1, wherein the arm is attached to the main body at, or in proximity to, the front of the main body.

13. An excavator vehicle according to claim 1, wherein the arm is provided with a hydraulic conduit for transmitting hydraulic pressure extending from the main body to the attachment, and the arm is provided with a cover above at least a part of the hydraulic conduit.

14. An excavator vehicle according to claim 13 wherein the arm is articulated, with an upper arm portion associated with the main body connected to a lower arm portion by a joint, the cover extending the length of the upper arm portion.

15. An excavator vehicle according to claim 1, wherein the power pack is mountable on the main body in a first operational power pack position, and is readily dismountable from the main body to be moved to a second operational power pack position remote from the main body, the excavator being adapted to enable power to be transmitted to the main body and the excavating attachment in the first and second operational power pack positions.

16. An excavator vehicle according to claim 15 wherein the excavator vehicle is provided with one or more power transmission conduits for connecting the power pack in the second operational power pack position to the main body.

17. An excavator vehicle according to claim 1, wherein the excavating attachment comprises a hydraulically-powered cutting tool for excavating rock and the like and a bucket for moving and collecting excavated rock.

18. An excavator vehicle according to claim 17, wherein the excavating attachment is elongate, and wherein the cutting tool is elongate and extends away from the bucket.

19. An excavator vehicle according to claim 1, wherein the power pack is electrically powered.

20. An excavator vehicle according to claim 1, comprising a wheeled or tracked arrangement for moving the excavator.

21. An excavator vehicle comprising:

an excavator main body having a front and a rear;

a wheeled or tracked arrangement for moving the excavator;

a conveyor;

an apron for the receipt of excavated material, the apron being located at or in proximity to the front of the main body, the conveyor extending from the apron to the rear of the main body and being operable to move excavated material from the front to the rear of the main body;

an arm comprising an attachment for excavating material and moving said excavating material towards the apron, the excavating attachment comprising an elongate hydraulically-powered cutting tool for excavating rock and the like and a bucket for moving and collecting excavated rock, the cutting tool extending away from the bucket;

a support associated with the front of the main body, the support being movable from a first position in which the support is in resilient contact with the ground to a second position in which there is substantially no contact between the support and the ground;

wherein the support comprises one or both of the apron and conveyor, the apron and/or conveyor being movable from a first position in which the support is in resilient contact with the ground to a second position in which there is substantially no contact between the support and the ground, and when the support is in resilient contact with the ground, the resilient contact between the ground and the support creates an upwards force of from 25% to 60% of the weight of the excavator vehicle;

a power pack operable to enable power to be transmitted to the main body and the excavating attachment when the power pack is located remote from the main body.

22. An excavator vehicle comprising:

an excavator main body having a front and a rear;

a wheeled or tracked arrangement for moving the excavator, a conveyor;

an apron for the receipt of excavated material, the apron being located at or in proximity to the front of the main body, the conveyor extending from the apron to the rear of the main body and being operable to move excavated material from the front to the rear of the main body;

an arm comprising an attachment for excavating material and moving said excavating material towards the apron, the arm being attached to the main body at, or in proximity to, the front of the main body, the excavating attachment comprising an elongate hydraulically-powered cutting tool for excavating rock and the like and a bucket for moving and collecting excavated rock, the cutting tool extending away from the bucket;

a support associated with the front of the main body, the support being movable from a first position in which the support is in resilient contact with the ground to a second position in which there is substantially no contact between the support and the ground;

wherein the support comprises one or both of the apron and conveyor, the apron and/or conveyor being movable from a first position in which the support is in resilient contact with the ground to a second position in which there is substantially no contact between the support and the ground, and when the support is in resilient contact with the ground the resilient contact between the ground and the support creates an upwards force of from 25% to 60% of the weight of the excavator vehicle;

a power pack operable to enable power to be transmitted to the main body and the excavating attachment when the power pack is located remote from the main body.

* * * * *